US008277037B2

(12) United States Patent
Michaelson

(10) Patent No.: US 8,277,037 B2
(45) Date of Patent: Oct. 2, 2012

(54) PRINTING APPARATUS

(76) Inventor: Nicholas David Michaelson, London (GB)

( * ) Notice: Subject to any disclaimer, the term of this patent is extended or adjusted under 35 U.S.C. 154(b) by 1352 days.

(21) Appl. No.: 11/628,439

(22) PCT Filed: Jun. 7, 2005

(86) PCT No.: PCT/GB2005/002246

§ 371 (c)(1),
(2), (4) Date: Jun. 14, 2007

(87) PCT Pub. No.: WO2005/120843

PCT Pub. Date: Dec. 22, 2005

(65) Prior Publication Data

US 2007/0242308 A1 Oct. 18, 2007

(30) Foreign Application Priority Data

Jun. 7, 2004 (GB) ..... 0412647.0

(51) Int. Cl.
*B41J 3/00* (2006.01)
*B41J 2/01* (2006.01)

(52) U.S. Cl. ..... 347/101; 347/4; 347/102; 347/103; 347/104; 347/105

(58) Field of Classification Search ..... 347/4, 101–105
See application file for complete search history.

(56) References Cited

U.S. PATENT DOCUMENTS 6,877,920 B2 * 4/2005 Fujioka ..... 400/613
6,973,272 B2 * 12/2005 Yamamoto et al. ..... 399/15
2005/0099443 A1 * 5/2005 Lapstun et al. ..... 347/14

* cited by examiner

*Primary Examiner* — Jason Uhlenhake
(74) *Attorney, Agent, or Firm* — Stetina Brunda Garred & Brucker

(57) ABSTRACT

A printing apparatus for printing a heat shrinkable flattened plastics tubing or other elongate printable medium, the apparatus comprising:

means for feeding at least one printable medium over a printer head; and a control means to control the sequence of printing operations on the medium, wherein the apparatus further comprises a return feed assembly to return the printable medium printed on a first face thereof inverted into the printing apparatus and off-set, e.g. spaced toward one side of the printing apparatus, relative to where it was first fed passed the print head for printing onto the obverse face of the medium, the apparatus being programmed to be set up initially with the medium installed for feeding/printing the first side whereby printing of the first side of the label/printable medium may be initiated and the printable medium stopped at a required set point along the medium for reverse feeding, allowing the medium to then be fed back through the printer for the printing of the second side before the printing resumes.

23 Claims, 7 Drawing Sheets

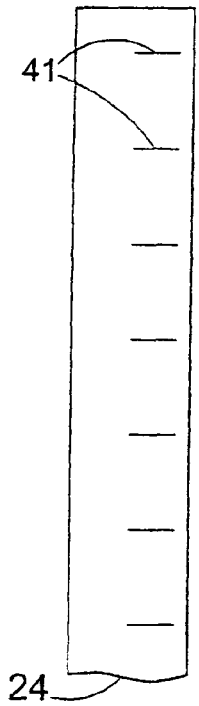
Fig. 4
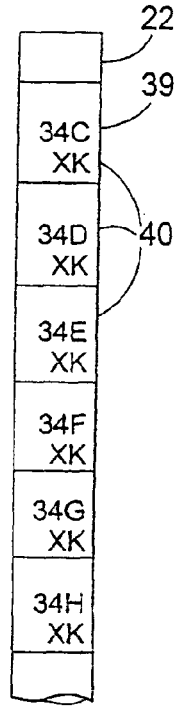
Fig. 5
Fig. 6
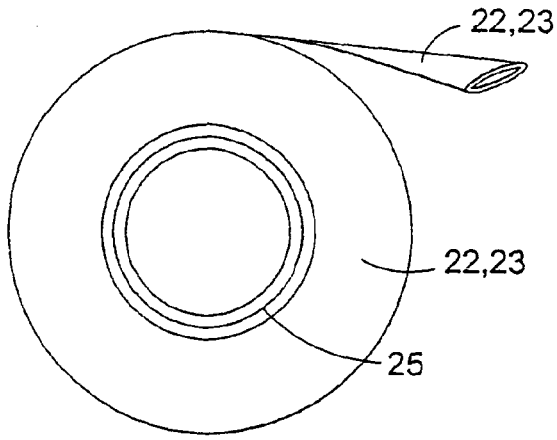

PRINTING APPARATUS

FIELD OF THE INVENTION

The present invention relates to a printing apparatus. It is particularly applicable, but not limited, to printing heat-shrinkable plastics tubing to serve as labels. The printable medium may comprise conventional paper as well as heat-shrinkable plastics tubing and other labelling media and will, for most labelling purposes, be sub-divided virtually or physically into labelling zones

BACKGROUND TO THE INVENTION

Heat shrinkable plastics tubing is used for labelling electric cables and the like, with each separately labelled section, or labelling zone, of tubing being cut or perforated to allow subsequent tearing, and then threaded over the corresponding cable before being heat shrunk to secure it in place on the cable. Because of the difficulty of printing direct onto the, normally flattened, plastics tubing, labels are generally mounted independently onto a carrier which is then fed through a printer. This of course is costly, involving many separate operations including pre-cutting the plastics tubing into lengths and fixing them to a roll of carrier material, and is difficult to automate. Alternatively pre-marking of the printable media is necessary. In our UK patent GB 2,387,142 we describe a new assembly, apparatus and method to enable flattened plastics tubing to be printed directly with a sequence of labels along its length.

That printing assembly comprises at least one supply of printable medium and a supply of control medium arranged on a common support such that both media may be passed together, in use, along adjacent paths at the same speed through printing apparatus, the supply of control medium having register control marks along its length, the register control marks being detectable by the printing apparatus for controlling the register of printing operations on the supply of printable medium performed by the printing apparatus as the printable and control media are passed through the printing apparatus.

Different sizes of printable media may be accommodated by this assembly using a guide comb within the printing apparatus that has a number of stepped channels through which the printable and control media run. This guide comb arrangement serves to maintain the respective lateral positions of the printable media and control medium but has been found not to be wholly reliable, especially in the context of the heat shrinkable plastics tubing It is thus one of the objects of the present invention to provide printing apparatus for printing heat shrinkable plastics tubing or similar printable media with enhanced reliability, substantially ensuring that the printable media and control media, if any, are maintained in the appropriate laterally spaced relationship during the printing.

More importantly still, a primary objective of the present invention is to provide an apparatus and method to enable flattened plastics tubing or other printable medium to be printed direct with a sequence of labels along its length on both sides of the printable medium in a cost and space efficient manner. This most preferably is done in a way that ensures register between the label content printed on one side of the medium with the label content printed on the other side of the medium. Prior attempts to provide double-sided printing have entailed use of two printing devices in tandem but this is prohibitively costly for most and no feasible alternative has previously been proposed.

Additionally, after extensive use of the control medium-registered printing apparatus and further development we have unexpectedly found a further, simpler, substantially effective and cost effective solution to the problem of controlling the print registration that avoids the need for provision of a control medium or any register marks. Accordingly, a yet further objective of the present invention is to enable flattened plastics tubing or other printable media to be printed direct with a sequence of labels along its length without need for providing register marks or other means to identify on the printable media the location for the start or end of each label.

SUMMARY OF THE INVENTION

According to a first aspect of the present invention there is provided a printing apparatus for printing a heat shrinkable flattened plastics tubing or other elongate printable medium, the apparatus comprising:

means for feeding at least one printable medium over a printer head; and a control means to control the sequence of printing operations on the medium, wherein the apparatus further comprises a return feed assembly to return the printable medium printed on a first face thereof inverted into the printing apparatus and off-set, e.g. spaced toward one side of the printing apparatus, relative to where it was first fed passed the print head for printing onto the obverse face of the medium, the apparatus being programmed to be set up initially with the medium installed for feeding/printing the first side whereby printing of the first side of the label/printable medium may be initiated and the printable medium stopped at a required set point along the medium for reverse feeding, allowing the medium to then be fed back through the printer for the printing of the second side before the printing resumes.

Preferably the apparatus is programmed to automatically stop printing on the first side at the required set point. Suitably the apparatus is programmed to be able to print, and suitably enabling the user to choose to print, the first label content repeatedly on the first side before the required set point is reached.

The return feed assembly suitably comprises at least one deflection guide, preferably such as a channeled roller or pulley, about which the printable medium bends/winds to alter its direction so that it may be fed back through the printing head again. The deflection guide may, for example, comprise a smooth curved element that may be rotatable about a spindle or may be static but could simply be a shoulder or corner of the apparatus, a rod or bar, even a slotted/apertured bar. The printable medium is twisted as it passes via the return feed assembly to invert the medium for printing of the obverse face. A or the deflection guide may be supported on a gantry/support arm about the print apparatus and suitably the return feed assembly has at least two such deflection guides.

Preferably the apparatus further comprises a guide member extending transversely to the direction of travel of the printable medium and control medium, and having a plurality of slot-shaped apertures therein at spaced intervals therealong, each to receive a respective length of the printable medium and control medium, if any, therethrough. Through this arrangement the plastics tubing is constrained to be of substantially consistent flattened cross-sectional thickness and width at the printing head whereby greater printing consistency is achieved. Any distortion of the cross-sectional form of the printable medium arising from the act of twisting it to double it back for the double-sided printing is substantially ironed out by the guide member. Suitably the guide member is positioned just prior to the print head, ie proximate the infeed end of the print head.

Following on from this latter feature, more generally according to a second aspect of the present invention there is provided a printing apparatus for printing a heat shrinkable flattened plastics tubing or other printable medium, the apparatus comprising means for feeding at least one printable medium over a printer head, and a register control means to control the sequence of printing operations on the Medium, wherein the apparatus further comprises a guide member extending transversely to the direction of travel of the printable medium and having one or more slot-shaped apertures therein, the or each to receive a respective length of printable medium therethrough.

Suitably the guide member is a bar positioned within the printing apparatus close to the printer head. The guide bar suitably has an axis that is parallel to the axis of the reel or supply drum for the print medium and preferably has two or more slot shaped apertures for guidance of any control medium and one or more printable media lengths/ribbons.

The guide bar is suitably demountable and replaceable with one or more further guide bars having slot shaped guide apertures of differing numbers and/or width. Indeed, the guide bar may have several apertures of differing widths. Preferably, however, it is adjustable whereby the width of the or each aperture may be adjusted. A shutter bar having alternate apertures and shutter panels along its length may be slideably mounted against the guide bar to move longitudinally of the guide bar to adjust the extent to which they occlude the apertures to adjust their length to suit different widths of printable medium. The shutter panels might be adjustable independently of each other or collectively and may be under processor control.

The printing apparatus may further comprise a guide comb that is mounted to the printing apparatus adjacent the point where the printable media exits the printing apparatus, whereby grooves in the guide comb further serve to align the printable media to maintain their lateral positioning.

Suitably the supplementary guide comb is adapted to be mounted to the exterior of the printing apparatus and suitably it is detachable and replaceable with one or more guide combs to suit differing numbers and widths of printable media.

To enable flattened plastics tubing or other printable media to be printed direct with a sequence of labels along its length in register but without need for providing register marks or other means on the print media or any control medium, a third aspect of the present invention provides a printing apparatus for creating and/or adjusting and for printing label content onto printable media, the apparatus comprising:

means for feeding at least one printable label medium over a printer head; and a processor configured to control the creation and/or manipulation of label content and to control the sequence of printing operations onto the medium, the processor means having a Windows® operator to enable label content to be created and/or adjusted (e.g. Windows® GDI) and to control the sequence of printing operations (Windows® printer driver), and further having an alternative printer driver to control the sequence of printing operations, the alternative printer driver being selectable in alternative to the Windows® operator printer driver, whereby when the alternative printer driver is selected the processor renders the label content to an internal bitmap, analyses the bitmap and via the alternative printer driver sends corresponding (absolute) control codes through the printer control port to the printer, bypassing Windows® pagination and page control, to govern pagination more accurately than allowing Windows to retain control.

The term bitmap is used herein in the generic sense of a set of bits that represents a graphic image, with each bit or group of bits corresponding to a pixel in the image.

Preferably the processor is configured to automatically select use of the alternative printer driver when a task is identified to be for thermal printing or is otherwise particularly suited to use of the alternative printer driver.

Suitably for each different label task there is a Template which not only defines the field size for the label but also identifies whether the label task is for a thermally printed label.

In the or each Template the field size/bitmap extent control data is suitably arranged to define substantially the exact amount of (white) space required to ensure accurate pagination of the printable label medium feed so that label content is properly centred for each label and will not, for example, spill over from one label to the next.

BRIEF DESCRIPTION OF THE DRAWINGS

In order that the invention may be better understood, a preferred embodiments will now be described, by way of example only, with reference to the accompanying diagrammatic drawings, in which:

FIG. 4 illustrates part of a print register control ribbon;

FIG. 5 illustrates part of a printable heat-shrinkable ribbon printed with labels under the register control of the corresponding portion of print register control ribbon shown in FIG. 4;

FIG. 6 is a side view of a spooled heat-shrinkable printable ribbon capable of use with the invention;

DESCRIPTION OF THE PREFERRED EMBODIMENTS

Figure 1:
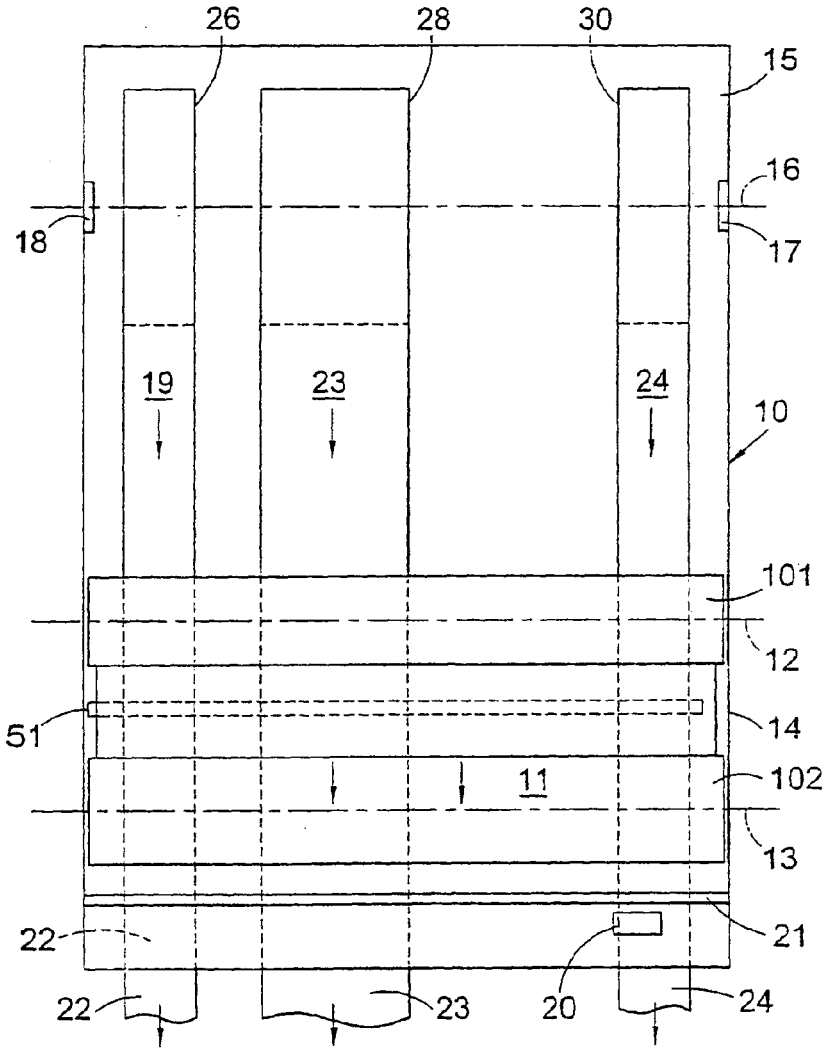
FIG. 1 is a schematic top view of a thermal printer suitable for use in the first aspect of the invention and embodying the second aspect of the invention.

Printing apparatus, in the form of a modified conventional thermal printer 10, is shown in FIG. 1. The printer may have a foot print of approximately 30 cm×20 cm and be approximately 15 cm high, although it could measure any size. The top view of FIG. 1 is very schematic and is visible once a lid (not shown) is hinged open. One compartment 14 accommodates a sacrificial printing component, here a print ribbon/web carriage 50 comprising a drum 101 of waxed paper for thermal printing, and a take-up drum 102 combined together in a removable module that is removable for replacement. In this example the supply drum and take up drum are journalled on axes 12 and 13, with the thermal ribbon 11 being guided past a print head beneath the thermal ribbon and between the drums 101, 102.

Figure 2:
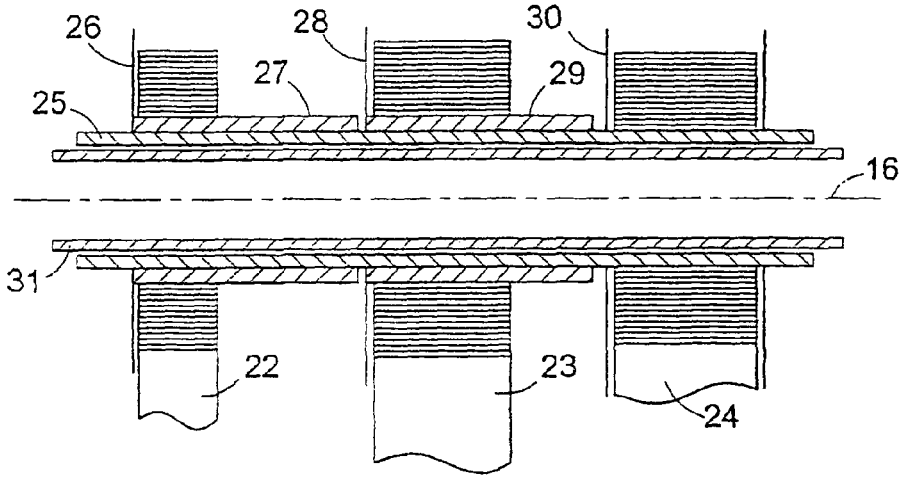
FIG. 2 is a longitudinal section through the printable medium support shaft of the apparatus.
Figure 10:
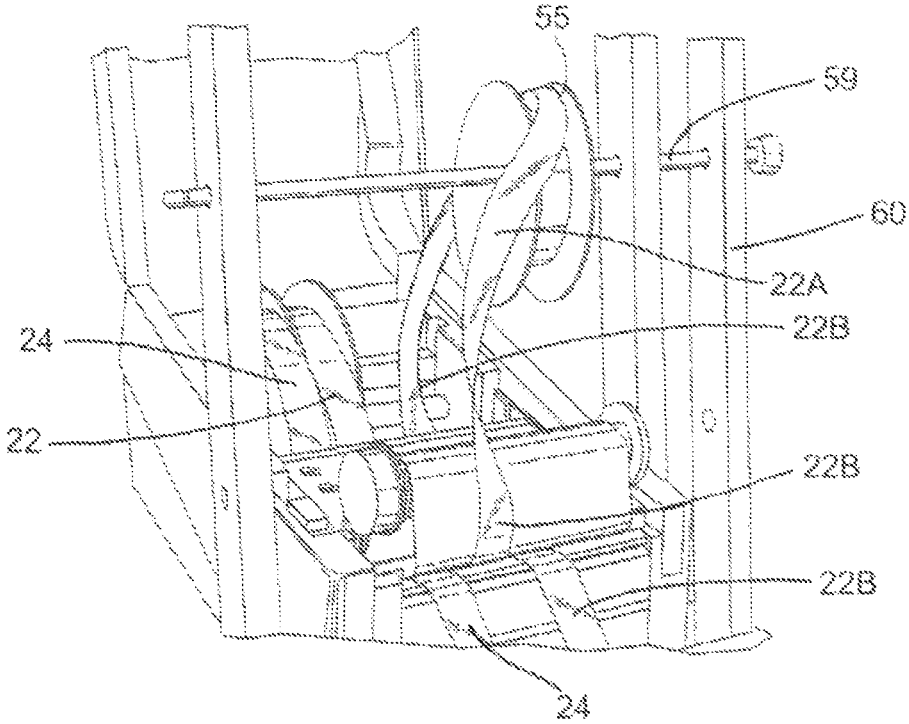
FIG. 10 is a perspective view of a first preferred embodiment of the printing apparatus of the first aspect of the invention to provide double-sided printing.

At the other end of the printer, a compartment 15 is arranged to accommodate an assembly for the printable medium, which in this example is an assembly of heat-shrinkable printable plastics tubing on spools, the assembly being shown in FIG. 2. The assembly is mounted on an axis 16 common to all the spools containing the ribbon (although this need not be the case), and is journalled at 17 and 18 for rotation on the axis 16. Where greater spool capacity is required the spools may alternatively be mounted outside the main printer casing, e.g. as shown in FIG. 10.

An optical detector 20 or reflector is arranged in the printer to detect print register control marks on a print register control ribbon 24 as it passes beneath the detector, and the printer has a control system (not shown) responsive to signals from the detector 20 to control the sequence of printing operations carried out by the print head 10 on the adjacent printable ribbons 22, 23 which are printed in parallel. [A preferred alternative embodiment and inventive aspect of the present invention that avoids need for detection of print registration for register control is described later below].

Figure 3:
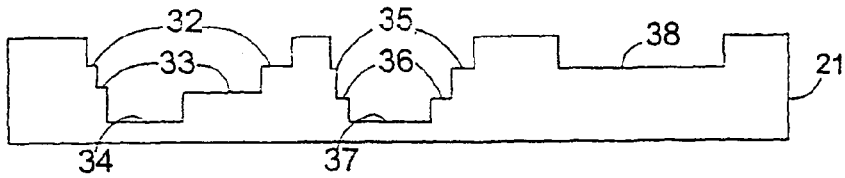
FIG. 3 is a side view of a guide comb for use in the printing apparatus of FIG. 1.

As shown in greater detail as an end view in FIG. 3, the printer has a guide comb 21 for guiding the three respective ribbons 22, 23 and 24 transversely as they move from the print head through the printer and out of the printer through a slot at the front end of the printer. The ends of the slot can be adjustable (not shown) to accommodate printable media of different widths. The end or ends may be defined by a movable end stop, or by a pin placed through a hole in the guide.

In the FIG. 2 example, a metal cylindrical spindle 31 is mounted on the axis 16 in the journals 17, 18, and the replaceable ribbon assembly is slid over the spindle 31. The ribbon assembly has a cylindrical cardboard tube 25 on which are mounted two spools 26, 28 of printable heat-shrink plastic flattened tubing 22, 23, of which a side view is shown in FIG. 6. In this example, the ribbons 22, 23 have different widths. For the sake of consistent alignment of printing operations in the print head 10, however, the left hand edge of each ribbon 22, 23 is arranged to lie at the same transverse position in the printer, regardless of the width of ribbon, and this is achieved by using hollow cylindrical spacers 27, 29 of equal length along the axis 16, to form the spools. Instead of hollow, coaxial spacers, there may be some form of alternative spacer such as a bar, or transverse projection from the spools or spindle. The ribbons may be wound directly on these spacers, abutting the inner surfaces of cardboard discs 26, 28, or alternatively they may be wound on cardboard cylinders which themselves are mounted over the spacers 27, 29. In an alternative embodiment no spacers are used and the spools are placed on the spindle adjacent to each other and suitably free to rotate independently of each other.

A paper or plastics ribbon 24 intended for print register control is wound on a similar spool 30, although in this example no spacer is required. The spools 26, 28 and 30 are all mounted coaxially and the ribbons are all wound in the same rotational sense. The print register control ribbon 24 is preprinted with register control marks as for example the marks 41 shown on a section of the ribbon 24 in FIG. 4. These marks are intended to signal the beginning or end of each separate page of labels or label 39 which is to be printed on the ribbon 22 or 23, as shown in FIG. 5, each separate label 40 being, in this example, of the same longitudinal length. It will be appreciated, however, that any type of printing along the length of the ribbon is possible under any register control scheme. The marks 41 could be of any type, and could be apertures or magnetic marks or the like, provided they may be detected by the printer. The print register control ribbon 24 is intended to pass always across the same part of the printer, so that the detector 20 reliably detects the register marks.

It may be required to print between labels. There may therefore be operating processing means to subdivide the regions between the register control marks and thereby effect printing on printable regions on the printable medium in positions between the corresponding register control marks. A line may be printed at a position corresponding to each of these subdivisions.

Figure 9:
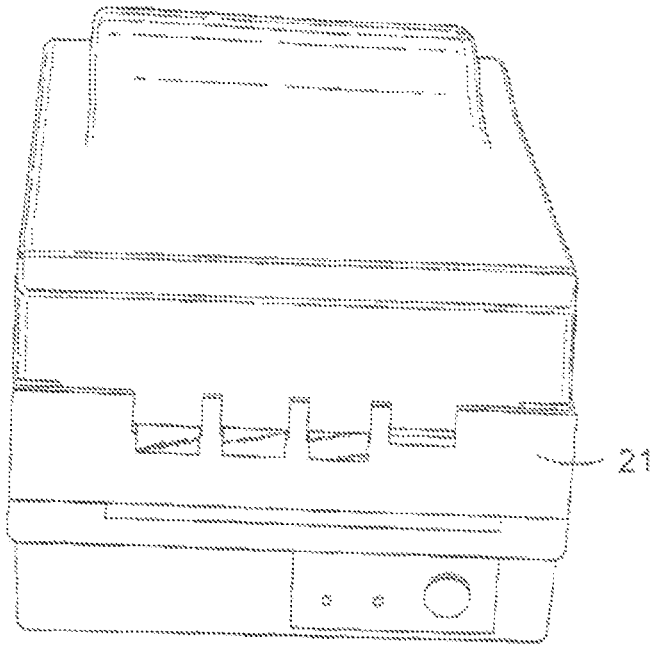
FIG. 9 is a perspective view of the printing apparatus with lid in place as viewed from the front where the print media exits the printing apparatus, and showing a detachable guide comb mounted to the front of the printing apparatus.

As discussed above, the transverse alignment of the ribbons 22 to 24 is controlled at the exit of the printer by the metal or plastics comb 21 in FIGS. 3 and 9. The design of the comb 21 shown in FIG. 3 is arranged with stepped grooves to accommodate a variety of different widths of ribbon 22, 23: the left most ribbon in FIGS. 2 and 3 would rest on shoulders 32 if it were the widest ribbon; or on shoulders 33 if it were less wide; and the ribbon 22 shown, being the narrowest, would fit into the recess 34. Correspondingly for ribbon 23, there are pairs of shoulders 35 and 36 for relatively wide ribbons, and a recess 37 for the narrowest. The shapes and configurations of the guide combs 21 may be varied to suit different types of printing operation and different materials of ribbon. In this example, just one guide recess 38 is shown for the register control ribbon 24.

In practice the use of a comb 21 with stepped grooves has not been found to be optimally reliable. FIG. 9 shows an arrangement of the guide comb 21 that has been improved to provide unstepped grooves, here four identical such grooves, the guide comb 21 being detachably mounted to the front of the printer by Velcro T™ or other suitable means and replaceable with one of a number of alternative guide combs 21 having different sizes and/or shapes and/or numbers of guide slots to suit different configurations and widths of printable media ribbon 22, 23. One guide comb 21 may have, for example, six relatively narrow (short in terms of length axially along the comb 21) grooves to suit five relatively narrow printable media ribbons and a control ribbon 24, while another comb 21 may have the groove for the control ribbon 24 (the dimensions of this do not need to vary from comb to comb) and two wide grooves to guide two wide printable medium ribbons. The demountable guide comb 21 may be mounted either way up, i.e. with grooves facing upwardly or downwardly.

Figure 7:
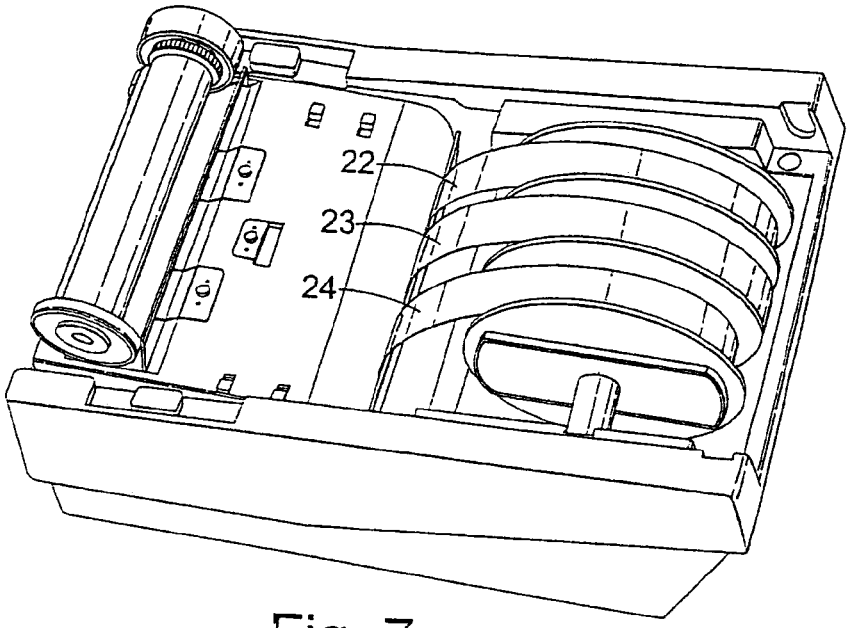
FIG. 7 is a perspective view from above of the printing apparatus of FIG. 1 when the ribbon carriage/print head is in its operative position.
Figure 8:
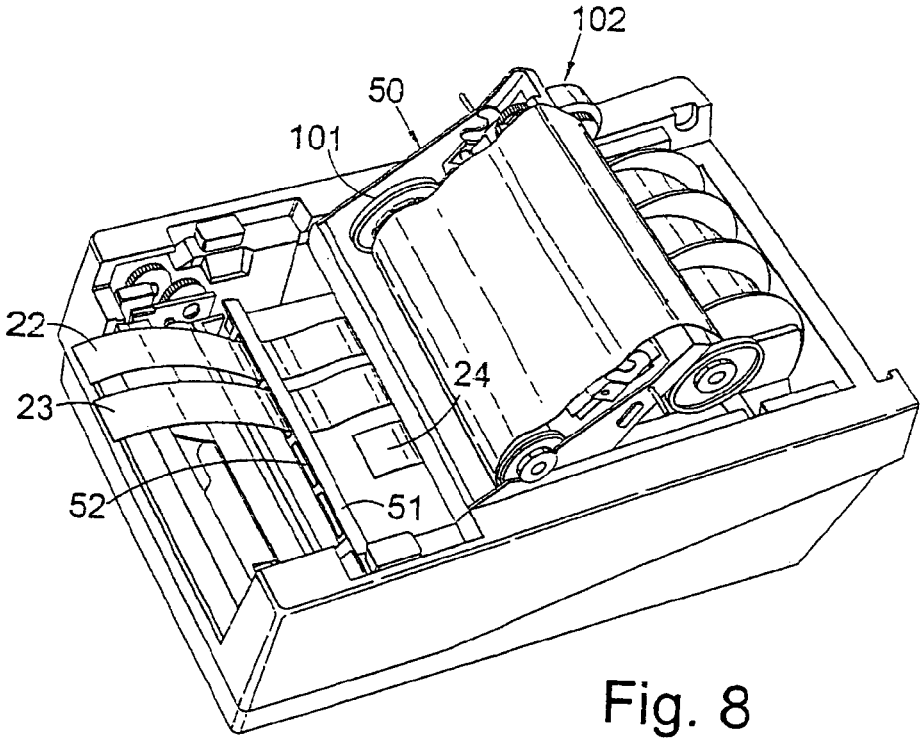
FIG. 8 is a perspective view similar to FIG. 7 but in which the ribbon carriage/print head is tilted away from its operative position to enable the guide bar to be viewed.

Referring to FIGS. 1, 7 and 8, transverse alignment of the ribbons 22 to 24 is rigorously controlled within the printer in the vicinity of the print head between the drums 101, 102 of the print ribbon carriage 50 by the provision of an apertured bar 51 that extends transversely across the printing apparatus. The apertured bar 51 has a plurality of elongate slot-shaped apertures 52, here four apertures, each of which is sufficiently long lengthwise of the bar 51 to accommodate the width of ribbon of printable material or control material passing therethrough.

The size and shape of each slot-shaped aperture 52 is such as to closely accommodate the respective printable material ribbon or control ribbon and so as to constrain the ribbon such that any variations in the flatness of the ribbon, especially the flattened printable plastics tubing ribbon 22, 23, do not interfere with the lateral positioning of the ribbons with respect to each other and the printer head and the ribbons 22,23 do not wander. The guide bar 51 is demountable to enable it to be replaced with a guide bar having a different set of slot-shaped apertures 52 to suit different widths or thicknesses of printable material ribbon 22, 23 or different numbers of ribbon.

By closely constraining the printable material ribbons 22, 23 in the vicinity of the print head so that their respective positions are tightly controlled at the point of printing, the errors that might otherwise arise from inconstant thickness and shape of the flattened tubular plastics ribbon 22, 23 are substantially avoided. Optimal control of transverse/lateral positioning of the ribbons 22, 23 is provided through use of a combination of the slot-apertured guide bar 51 with a guide comb 21 as illustrated.

In further refinements to the guide bar 51, this may be arranged to have selectively adjustable apertures 52 to allow for adjustment to suit the differing widths, numbers or thicknesses of printable media ribbon 22, 23. For example, a shutter bar (not shown) suitably having alternating apertures and shutter panels along its length may be slideably mounted against the guide bar 51 to move longitudinally of the guide bar 51 to adjust the extent to which the shutter panels occlude the apertures 52 to adjust the size of the apertures lengthwise of the guide bar 51 to suit different widths of ribbon 22,23.

The spools of FIG. 2 may each have two discs such as disc 26 for retaining the ribbon, and adjacent spools may be adhered to each other for example with the use of double sided adhesive tape. Thus the spools may be in the form of bobbins or reels, if desired. In this example, the ribbons are driven by rotation of the spindle 31 and advanced under the control of the printer which responds to the register marks. Alternative drive arrangements would be possible.

In use, an assembly as shown in FIG. 2 is mounted over the spindle 31 and inserted into the compartment 15, threading each ribbon over the guides 21 and through the slot 19 as shown in FIG. 1. The printer is operated in a conventional fashion to print a sequence of labels or other printed matter onto each printable ribbon, under the control of signals derived from the register control marks 41 on the register control ribbon which passes at the same speed as the printable ribbons through the printer. In this example, the register control ribbon is sacrificed once the printable ribbon has been used up, and the entire assembly of FIG. 2 is replaced for the next sequence of printing.

In some alternative embodiments of the invention, the spooled register control ribbon could be replaced with a reusable loop of marked ribbon. This could be removable from the assembly containing the printable ribbon, but in use it would be driven together with the printable ribbon and at the same longitudinal speed through the printer.

The printable medium is in the form of ribbon, i.e. elongate and substantially flat. The printable medium and/or the register control-medium are conveniently stored by winding them around spools, such as bobbins or reels, but other carriers such as cartridges are possible, and the media could be fan-folded for fan-feeding. The common support is shown in the example as a cylindrical support mountable over a spindle, but other supports, rotary or otherwise, are possible, and indeed the supplies of the media need not be coaxial.

Double-Sided Printing

Referring now to FIG. 10, this shows a first preferred embodiment of the first aspect of the present invention, namely adaptation of the printing apparatus to loop the printable medium, as printed on its top face 22A, back through the printer inverted to enable the print head 10 to print on to the obverse/reverse face 22B of the printable medium 22. To do this the printable medium 22 is twisted about its axis between the point that it emerges from the exit end of the printer head 10 and the point that it is fed back into the infeed end of the printing head 10 again. It is fed back into the infeed end of the printing head 10 offset to one side relative to where it was originally fed through.

A set of one or more pulley-type channeled rollers 55 to redirect the printable medium back through the printer is provided on a spindle shaft 59 supported over the printer by a gantry 60. The ribbon 22 is furled as/before or after it passes over the channeled roller 55 so that it is inverted as it passes back into the printer head 10. The printing of the label on the reverse face of the printable medium 22,23 may be synchronised again by the control markings of the control ribbon 24.

This ingeniously simple arrangement is surprisingly effective, being substantially free-running and not liable to jam and is also surprisingly tolerant and versatile and even usable for precision applications where it is important to have messages printed on to both of the opposing faces of the printable ribbon in direct correspondence with each other. For example, a given label content/message may be printed on one face within a given label zone and reproduced on the obverse face substantially exactly aligned with the label content on the first face within the footprint of the same label zone. Control logic is provided to co-ordinate the delayed reprinting to be carried out on the reverse face at the right point.

Figure 11:
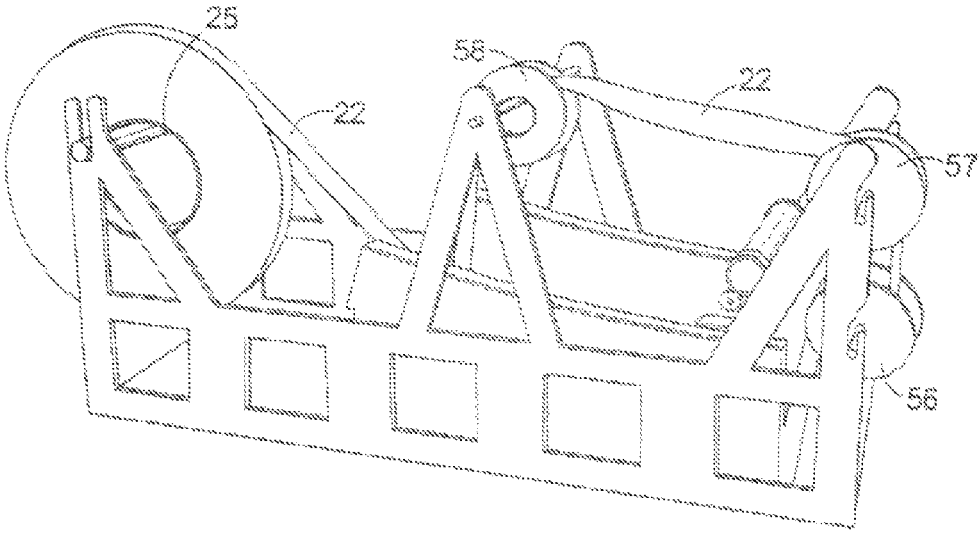
FIG. 11 is a perspective view of a second preferred embodiment of the printing apparatus of the first aspect of the invention to provide double-sided printing.
Figure 12:
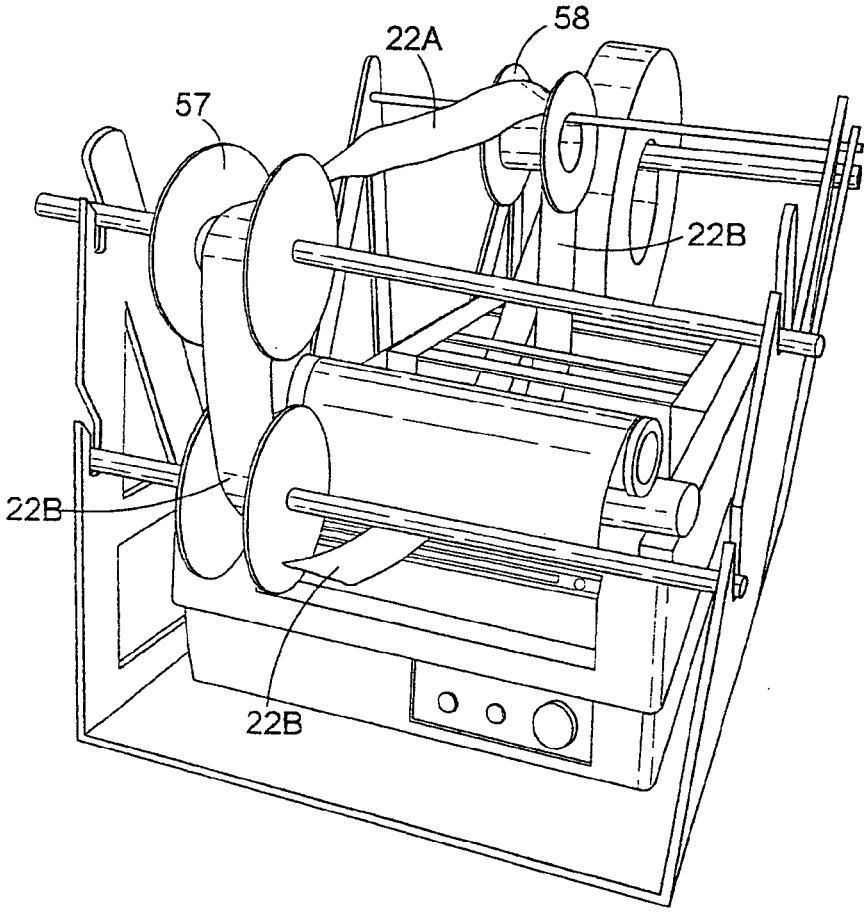
FIG. 12 is a side elevation view of the printing apparatus of FIG. 11.

In the second embodiment, of FIGS. 11 and 12, the return feed is shown as being looped upwardly over the printing head 10. In this embodiment, the loop of printable medium 22 exiting the printing head 10 passes around a first lower guide pulley 56 and then upwardly over a second guide pulley 57 spaced above the first guide pulley 56 before extending rearwardly and over a third upper pulley 58 and then down to re-enter the print head 10. The printable medium in the loop is furled/twisted to invert it as it passes along the lengthy stretch between the second 57 and third 58 pulleys. This geometry of the return feed is not only free-running but also gives good clearance for the opening up of the upwardly hinge-opening printer mechanism.

In further alternative arrangements the return feeding/loop supporting and guiding assembly may preferably be configured to direct the loop beneath the printer head rather than above it or, less suitably, to direct it laterally outwardly of the printer and then back.

The set-up was originally configured to include a leader tape, which may be a separate cheaper medium, at the start of each reel/ribbon of the printable medium and that is of a length (eg 200 mm to 500 mm) to cover the extent of the loop since that length will not be printable on in a double-sided manner. The leader may be adhered or otherwise fastened to the printable medium and it may be marked or printed on or printable on to bear test/calibration information such as pagination guide marks. Pagination guide marks serve to show the extent of deviation of the installed print medium loop from an expected position to ensure that when the second side is printed the printed labels on the second side are in their expected/correct positions on the printable medium. Indeed, as a generality the apparatus only needs to be calibrated once, each time fresh printed medium is installed, to allow for the fact that the extent of tightness/slackness of the loop can vary from one installation to the next. Accordingly calibration/pagination mark(s) may be provided only on the leader tape.

In an important improvement to the method and to the programming of the system that significantly economises on materials usage, the apparatus is set up and adapted to be set up initially with the label/printable medium installed for printing the first side but not installed fed right through the reverse feed arrangement. Thus printing of the first side of the label/printable medium is initiated and the printable medium is stopped, particularly preferably automatically, at a required set point along the medium for reverse feeding. The user may then feed the medium back through the printer for the printing of the second side before the printing resumes. A small amount of fine-tune is then executed to ensure that the second side is printed properly in register with the first. By this means a substantial length of the printable medium that would effectively otherwise only be used as a leader or substituted by an attached leader is used profitably. The savings from this along with added calibration opportunities this provides, as discussed below, are very valuable and surprisingly outweigh the convenience of otherwise installing the medium fully looped through the apparatus at the outset.

As a further facility, by setting up of the apparatus with the printable medium only installed initially for printing the first side and then being stopped, again suitably automatically, the portion that would otherwise serve as a leader may be used to repeat print ident or label content to facilitate calibration/error correction. The user may choose to print the first ident or label content between one and say five times in a first pass. With five repeat prints in the first pass, when the medium is then reverse fed the alignment of the label contents will be substantially assured. For this the software is adapted to adjust for the number of repeat prints on the first side when preparing to print on the second side. The software suitably also adjusts by, on the second side, printing a first label content 'page' and stopping for review and optionally adjustment, printing a second label content page and stopping etc until the user (or feedback control system) is satisfied with the registration and signals for the printer to run freely. If there are any programmed repeats of the first ident/label content not used in the fine tune, the software may accommodate for this when printing the second side.

Amongst various approaches for calibration/pagination adjustment, the leader and/or printable medium may carry recognisable marks at predetermined positions or intervals therealong and may even be marked with a metric (eg mm) scale for direct visual assessment of extent of deviation from reference. The marks on the leader or medium as it returns back into print head 10 may be compared to a static guide point on the apparatus or compared against the leader/print medium length that lies alongside and is being fed into the printer head for the first time. The leader or print medium may have calibration marks on both top and bottom faces for this purpose.

If desired, two or more printable media ribbons may be readily handled by the printer in tandem even when double sided printing on one or more of the ribbons.

Control of Print Register without Need of Detectors of Registration Marks or Control Media Whether for labelling of electrical wiring or other labelling applications, the system of the present invention generally comprises a processor such as that of a PC suitably with a keyboard and screen to enable the user to enter alphanumerical text data for filling in label content boxes of user-defined or pre-prepared label templates. The system may also have a CDROM or DVDROM drive whereby software for controlling the label printing process, and optionally also a range of pre-prepared label templates for industry standard labels, may be downloaded by the user.

The system further comprises the printer, suitably a thermal printer, operatively coupled to the processor to receive print instructions from the processor. The thermal printer may be of the type outlined in our earlier patent GB 2,387,142, or FIGS. 1 to 10 hereinafter, having a reel form feed for the printable media (e.g. reels of flattened plastics tubing), even with several reels mounted on a common spindle if desired. However, the printer does not need to incorporate a register or control medium-and-detector arrangement as set out in that patent or described above with respect to FIGS. 1 to 10. Preferably it instead has a manually or automatically selectable auxiliary printer driver that is adapted to optimise print formatting and which suits thermal printing especially well. This printer driver is suitably supplied in software via CDROM or DVDROM as noted above but may of course be supplied on other storage media or even embodied in hardware.

Indeed, the processor itself may be built into the printer rather than be part of a separate PC and may even comprise two or more linked processors. Significantly, however, a feature of the system is that it is generic in being adapted for use in the universal Windows® operating system environment, giving the broadest base of users the familiar and otherwise versatile Windows® environment for creating and formatting or otherwise adapting label content for their labelling application.

However, if the label content template data indicates that the job is to be thermally printed, the software of the present system is adapted to automatically select the special auxiliary thermal printer driver(s) instead of using the inherent Windows® printer driver of the Windows® operating system that is otherwise always used by Windows®. If selected, the software renders the label content to an internal bitmap. The bitmap is then analysed and absolute control codes are sent from the auxiliary printer driver through the printer control port to the printer, bypassing the Windows® pagination and page control logic completely.

The bitmap extent control data is used to govern pagination far more accurately than allowing Windows to retain control. The template design includes the exact amount of white space required to ensure accurate pagination of the physical label feed.

Flow Chart:

Does the "Job Template" indicate thermal label content?
  Y: Select output via thermal driver
  N: Select output via Windows printer driver
loop_for_labels:
Render all label's content for each reel/delayed label side to an internal bitmap
sweep composite bitmap row by row
construct printer control codes to convey label content image to
  thermal printer as an encoded graphic row
send field size information to the printer as described by template
loop_for_graphic row:
send graphic control data
send pre-calculated bitmap graphic rendering data
last row?
  N: loop to print next graphic row
  Y: send batch end and reel advance codes
end of data?
  N: loop to print next label
  Y: end job The Rendering Process The Windows® Graphic Device Interface (GDI) will position and format the label content in the form of a bitmap. The usual fate of that bitmap is for it to be transferred to a hardware device (rendered) by a standard Windows® device (e.g. printer) driver. The Windows® Thermal printer driver, however, fails to achieve the results required for many of the labelling solutions.

To exploit the benefits of the Windows® environment while addressing the limitations of the Windows® Thermal printer driver, the software provides an auxiliary driver. The software first formats a bitmap to conform to the printer's pixel resolution in terms of dots-per-micrometer. The Windows® GDI is programmed to plot all information using the appropriate scaling factors to ensure accuracy of representation.

Once the label contents have been rendered by the Windows® GDI, instead of handing the internally stored bitmap of the label image to the printer driver to render to the printer, the software internally analyses the bitmap and sends the correct control codes to the printer to produce the exact output and control required. The bitmap is passed to the internal rendering routine, which loops through the bitmap one "row" of pixels at a time, counting consecutive 25% white pixels as white and 75% coloured pixels as black. All control data is sent directly to the printer using the selected interface (serial or parallel communications port) via direct port drivers rather than through the Windows® printer control handlers.

The Bitmap Analysis Procedure:

1) The rendering routine sends a control code to the printer that describes the precise extent of the approaching bitmap.

2) A row can be interpreted as vertically orientated when a rotation is required. This avoids the processing overhead of performing a bitmap rotation operation and instead samples the bitmap pixels in a non-linear order to achieve a "virtual rotation".

3) Each pixel in the bitmap is examined in turn (vertically or horizontally as the desired orientation indicates) and counted as either a black or white pixel.

4) For each change of pixel colour (black<->white) the current pixel count for the previous colour is recorded, translated to an encoded "run length" and is added to the printer control stream as required by the printer run-length encoding specification. The count for the changed colour is reset and started afresh for the new colour.

5) At the end of each pixel row (or column) an outstanding count is encoded and the loop restarts at the next row (or column).

6) The row encoding descriptor data is recorded in the event of any immediately following rows being duplicated. When this happens, duplicated rows are counted and sent to the printer as a "Duplicate previous 'n' rows" command. This improves printing efficiency 7) Once the label content bitmap rendering loop has completed, a final reckoning is performed. Should it transpire that no printable data was found, the label print is cancelled and the data buffer is flushed to ensure that no blanks labels are produced.

The Thermal Printer Object Code is as Follows:

```
ThermalPrinter = class                                  // Defines the Thermal printer
                                                        // control object
  private
  Device    : TextFile;                                 // Links to the hardware port
  Batch     : String;                                   // Accumulates label control data
  FImage    : TBitmap;                                  // Used to render label images
  bLandscape : Boolean;                                 // Rotation flag
  function IsLHS: Boolean;                              // Is template Label Heat Shrink?
  function GetHeight: Integer;                          // Access function for Image data
  function GetWidth: Integer;                           // Access function for Image data
  procedure SetHeight(h: Integer);                      // Access function for Image data
  procedure SetWidth(w: Integer);                       // Access function for Image data
  function IsPaged: Boolean;                            // Checks template for pagination
  public
  procedure Open( const filename: string);              // Start printing
  procedure Close;                                      // End printing
  procedure Flush;                                      // Clear saved batch data
  procedure Print( str : String);                       // Render to batch
  function addBatch( str : String) : Integer;           // Batch accumulation
  function endBatch : Integer;                          // Batch accumulation
  procedure cancelBatch;                                // Batch cancellation
  procedure Render( APrnRec : TPRNREC);                 // Plot a label
  procedure SetSize( h, w: Integer);                    // Programs the bitmap
                                                        // to handle templated
                                                        // label size
  published
  property Image : TBitmap read FImage;
  property Width : Integer read GetWidth write SetWidth;
  property Height : Integer read GetHeight write SetHeight;
  property Landscape : Boolean read bLandscape write bLandscape;
  property LHS : Boolean read IsLHS;
  property Paged : Boolean read IsPaged; end;
```

Multi-Reel Jobs can Run Long Instead of Across

The system of the present invention has capability to print using multiple reels simultaneously. This can present a logistical problem. Consider the scenario where the labels are produced across three reels in this sequence:

| | | |
|---|---|---|
| 1 | 2 | 3 |
| 4 | 5 | 6 |
| 7 | 8 | 9 |
| 10 | 11 | 12 |
| 13 | 14 | 15 |
| 16 | 17 | 18 |

and so on.

The issue here is that each of the three reels now contain a non-contiguous sequence. The software of the present invention is adapted to address this problem. It does so by pre-calculating the endpoint of the label content sequence, dividing that by the number of reels and using the resultant figure as a horizontal increment for each row. This would (in the limited case above) result in the sequence:

| | | |
|---|---|---|
| 1 | 7 | 13 |
| 2 | 8 | 14 |
| 3 | 9 | 15 |
| 4 | 10 | 16 |
| 5 | 11 | 17 |
| 6 | 12 | 18 |

Now each reel holds a contiguous sequence, making the reels much easier to employ at the distribution phase of the physical labelling task.

For double-sided printing the software is adapted to the following criteria:

1) to print the first side of the label using the thermal printer drive as described;

2) to store the print data (raw, not image) for deferred printing; and 3) to monitor the flow position and, at a pagination offset, to begin re-printing the retained information at a horizontal offset to the original stream such that it appears on the 2nd spool position, which is the original label material twisted and returned.

In the preferred embodiment the software provides a variable vertical offset to enable fine tuning of the second side of the label print data. Both coarse and fine tuning ability are provided within the software to cater for the variability in label tension, label media and template design. The coarse tune capability provides for future enhancements/changes to the media carriage construction. Tuning may make use of the system as described in our earlier UK Patent GB-23676170, the contents of which are incorporated herein by reference.

The foregoing description is meant to be illustrative and not limiting. Various changes, modifications, and additions may become apparent to the skilled artisan upon a perusal of this specification, and such are meant to be within the scope and spirit of the invention as defined by the claims.

The invention claimed is:

1. A printing apparatus for printing on an elongate printable medium, the apparatus comprising:

a feeder for feeding at least one continuous length of printable medium over a printer head wherein the at least one continuous length of printable medium passes over the printer head at two separate areas along its longitudinal length; and a controller to control the sequence of printing operations on the continuous length of printable medium wherein the apparatus further comprises a return feed system to twist the printable medium between the two separate areas and return the printable medium printed on a first face thereof inverted into the printing apparatus and laterally offset relative to where it was first fed over the print head for printing onto the obverse face of the printable medium.

2. A printing apparatus as claimed in claim 1, wherein the return feed system comprises at least one deflection guide about which the printable medium bends or winds to alter its direction so that it may be fed back through the printer head again.

3. A printing apparatus as claimed in claim 1, in combination with the printable medium in use, wherein the printable medium is twisted about its longitudinal axis between a first area that the printable medium emerges from an exit end of the printer head and a second area that the printable medium is fed back into an infeed end of the printer head as it passes via the return feed system to invert the medium for printing on the obverse face.

4. A printing apparatus as claimed in claim 1, further comprising a guide member extending transversely to the direction of travel of the printable medium, and having a plurality of slot-shaped apertures therein at spaced intervals therealong, each to receive a respective length of the printable medium therethrough.

5. A printing apparatus as claimed in claim 4, wherein the guide member is a guide bar positioned within the printing apparatus close to the printer head.

6. A printing apparatus as claimed in claim 5, wherein the guide bar has an axis that is parallel to the axis of a supply drum for the printable medium.

7. A printing apparatus as claimed in claim 4, wherein the guide member is demountable and replaceable with one or more further guide members having slot-shaped guide apertures of differing numbers and/or lengths.

8. A printing apparatus as claimed in claim 7, wherein the guide comb is mounted to the exterior of the printing apparatus.

9. A printing apparatus as claimed in claim 4, wherein the guide member is adjustable in aperture size.

10. A printing apparatus as claimed in claim 4, wherein the printing apparatus further comprises a guide comb that is mounted to the printing apparatus, whereby grooves in the guide comb further serve to align the printable media to maintain their lateral positioning.

11. A printing apparatus as claimed in claim 1, wherein the apparatus further comprises a processor configured to control creation, manipulation or both creation and manipulation of label content and to control the sequence of printing operations onto the medium, the processor means having an operator to enable label content to be created, adjusted or created and adjusted and to control the sequence of printing operations, and further having an alternative printer driver to control the sequence of printing operations, the alternative printer driver being selectable in alternative to the operator printer driver, whereby when the alternative printer driver is selected the processor renders the label content to an internal bitmap, analyses the bitmap and via the alternative printer driver sends corresponding control codes through the printer control port to the printer, bypassing pagination and page control of the operator, to govern pagination more accurately than allowing the operator to retain control.

12. A printing apparatus as claimed in claim 1, wherein the printer has a processor therein or linked thereto in use that is programmed to print onto the printable medium first face, to store information to be printed onto the obverse face of the printable medium for deferred printing and to begin printing the stored information on the obverse face at the spatial offset to coincide with the returned printable medium and after a required time delay to coincide with the required sequential position along the medium.

13. A printing apparatus as claimed in claim 12, wherein the apparatus monitors a flow position of the printable medium.

14. A printing apparatus as claimed in claim 1, wherein the return feed system comprises a frame that is external to the printer casing and which has the at least one deflection guide.

15. An apparatus as claimed in claim 1 wherein the apparatus is programmed to be set up initially with the medium installed for feeding/printing the first face whereby printing of the first face of the label/printable medium may be initiated and the printable medium stopped at a required set point along the medium for reverse feeding, allowing the medium to then be fed back through the printer for the printing of the obverse face before the printing resumes.

16. A printing apparatus as claimed in claim 15, wherein the apparatus is programmed to automatically stop printing on the first face at the required set point.

17. A printing apparatus as claimed in claim 15, wherein the apparatus is programmed to enable the user to choose to print the first label content repeatedly on the first face before the required set point is reached.

18. An apparatus as claimed in claim 1 further comprising a means for inverting the printable medium to print onto the obverse face of the printable medium.

19. A printing apparatus for printing on a heat shrinkable flattened plastics tubing or other elongate printable medium, the apparatus comprising:

means for feeding at least one printable medium over a printer head;

a control means to control the sequence of printing operations on the medium, wherein the apparatus further comprises a return feed assembly having at least one deflection guide supported on a gantry/support arm above the printing apparatus, the printable medium bends or winds to alter its direction about the deflection guide to return the printable medium printed on a first face thereof inverted over the printer head and offset relative to where it was first fed passed the printer head for printing onto the obverse face of the medium, the apparatus being programmed to be set up initially with the medium installed for feeding/printing the first face whereby printing of the first face of the label/printable medium may be initiated and the printable medium stopped at a required set point along the medium for reverse feeding, allowing the medium to then be fed back over the printer head for the printing of the obverse face before the printing resumes.

20. A printing apparatus for printing on an elongate printable medium, the apparatus comprising a feeder for feeding at least one continuous length of printable medium over a printer head at two separate areas along a longitudinal length of the printable medium, a register control means to control the sequence of printing operations on the medium, a return feed system to twist the printable medium between the two separate areas and return the printable medium printed on a first face thereof inverted into the printing apparatus and laterally offset relative to where it was first fed over the print head for printing onto the obverse face of the printable medium, wherein the apparatus further comprises a guide member extending transversely to the direction of travel of the printable medium and having two or more slot-shaped apertures therein operative to receive a respective length of printable medium therethrough at least two of the apertures.

21. A method for printing on both sides of a printable medium, the method comprising the steps of:

feeding a continuous length of printable medium through a printing apparatus having a printer head wherein the continuous length of printable medium is sufficiently long so that the printable medium passes adjacent to the printer head at two separate locations along its longitudinal length;

aligning a first side of the printable medium to the printer head for printing on the first side of the printable medium;

twisting the printable medium along its longitudinal axis for allowing an opposed second side of the printable medium to be aligned to the printer head;

aligning the second side of the printable medium to the printer head for printing on the second side of the printable medium;

printing on the first side of the printable medium with the printer head; and printing on the second side of the printable medium with the printer head.

22. The method of claim 21 wherein the steps of printing on the first side and printing on the second side are accomplished simultaneously.

23. The method of claim 21 wherein the steps of printing on the first side and printing on the second side are accomplished sequentially.

* * * * *